US009629762B2

(12) United States Patent
Aviv

(10) Patent No.: US 9,629,762 B2
(45) Date of Patent: Apr. 25, 2017

(54) WHEELCHAIR CURB-CLIMBING AND CURB-DESCENDING SYSTEM

(71) Applicant: Ilan Aviv, Tel Aviv (IL)

(72) Inventor: Ilan Aviv, Tel Aviv (IL)

(73) Assignee: STEP-UP OLIM MADREGA LTD, Tel Aviv (IL)

( * ) Notice: Subject to any disclaimer, the term of this patent is extended or adjusted under 35 U.S.C. 154(b) by 28 days.

(21) Appl. No.: 14/761,502

(22) PCT Filed: May 27, 2014

(86) PCT No.: PCT/IL2014/050475

§ 371 (c)(1),
(2) Date: Jul. 16, 2015

(87) PCT Pub. No.: WO2014/191993

PCT Pub. Date: Dec. 4, 2014

(65) Prior Publication Data

US 2016/0067122 A1 Mar. 10, 2016

(30) Foreign Application Priority Data

May 30, 2013 (GB) ..... 1309711.8

(51) Int. Cl.

| | |
|---|---|
| ***A61G 5/06*** | (2006.01) |
| ***A61G 5/04*** | (2013.01) |
| *A61G 5/10* | (2006.01) |

(52) U.S. Cl.

CPC ..... *A61G 5/068* (2013.01); *A61G 5/04* (2013.01); *A61G 5/104* (2013.01);
(Continued)

(58) Field of Classification Search

CPC ..... A61G 5/068; A61G 5/04
(Continued)

(56) References Cited

U.S. PATENT DOCUMENTS 1,591,529 A * 7/1926 Guerber ..... A61G 5/06 188/2 F
3,295,858 A * 1/1967 Addison, Jr. ..... A61G 5/061 280/11

(Continued)

FOREIGN PATENT DOCUMENTS

| | | |
|---|---|---|
| CN | 101869522 | 2/2012 |
| DE | 3230179 | 2/1984 |

(Continued)

*Primary Examiner* — Jacob Knutson
(74) *Attorney, Agent, or Firm* — Mark David Torche; Patwrite LLC

(57) ABSTRACT

A wheelchair curb-climbing and curb-descending system for aiding a wheelchair to negotiate a curb. The system includes a wheelchair attachment mechanism; a pair of front arms adapted to extend to lift a front portion of wheelchair and to retract back to lower the front portion of the wheelchair; a pair of rear arms adapted to extend to lift a rear portion of wheelchair and to retract back to lower the rear portion of the wheelchair. The system further includes an arm extending mechanism for extending/retracting the arms; a rotatable lifting-arm wheel at free ends of each arm; a wheel motor for rotating the arm wheels; an operation control unit; and a leveling mechanism for ensuring the seat of the wheelchair remains substantially level to the ground during operation of the system.

3 Claims, 21 Drawing Sheets

(52) U.S. Cl.
CPC ..... *A61G 2203/10* (2013.01); *A61G 2203/34* (2013.01); *A61G 2203/42* (2013.01)

(58) Field of Classification Search
USPC .... 180/11, 12, 13, 15, 8.1, 8.2, 8.3, 8.4, 8.5, 180/8.6, 8.7; 280/5.2, 5.3, 5.32, 5.28, 280/5.22, 5.24, 250.1
See application file for complete search history.

(56) References Cited

U.S. PATENT DOCUMENTS

RE28,256 E * 11/1974 Zamotin ..... A61G 5/066 280/5.22
3,905,437 A * 9/1975 Kaiho ..... A61G 5/047 180/15
4,132,423 A * 1/1979 Chant ..... A61G 5/06 280/5.3
4,247,125 A * 1/1981 Rayment ..... A61G 5/06 280/250
4,455,029 A * 6/1984 Taylor ..... A61G 5/023 180/8.2
4,962,942 A * 10/1990 Barnett ..... A61G 5/023 280/250.1
6,428,020 B1 * 8/2002 Steadman ..... A61G 5/06 280/47.25
6,554,086 B1 4/2003 Goertzen et al.
2003/0116927 A1 * 6/2003 Quigg ..... A61G 5/061 280/5.22
2003/0127259 A1 7/2003 Logstrup
2003/0183428 A1 * 10/2003 Hedeen ..... A61G 5/061 180/9.32
2011/0276233 A1 * 11/2011 Lofstrand ..... A61G 5/04 701/49

FOREIGN PATENT DOCUMENTS

EP 0436103 7/1991
JP 11309178 11/1999
JP 2001017475 1/2001
JP 2001212181 8/2001

* cited by examiner

WHEELCHAIR CURB-CLIMBING AND CURB-DESCENDING SYSTEM

FIELD OF THE INVENTION

The present invention relates to equipment for aiding the handicapped, in particular, wheelchairs and accessories.

BACKGROUND OF THE INVENTION

Wheelchairs are commonly used by people with ambulatory problems. A common issue with wheelchairs is that they do not easily roll or otherwise progress up and down step-like or elevated structures, such as sidewalk curbs; and if they do, it is typically via a complex mechanism and/or a mechanism that causes the user to be tilted, which can be uncomfortable or even dangerous to the user, as well as expensive.

The following publications are believed to represent the current state of the art: U.S. Pat. No. 6,554,086 (Goertzen et al., Apr. 29, 2003); U.S. Pat. No. 8,292,010 (Puskar-Pasewicz, et al., Oct. 23, 2012); U.S. Pat. No. 7,316,282 (Mulhern et al., Jan. 8, 2008); U.S. Pat. No. 7,360,792 (Turturiello et al., Apr. 22, 2008) US 2010/096194 (Starcevic, Apr. 22, 2010); and WO 1998/046184 (Schaffner et al., Oct. 22, 1998) all of which are incorporated herein by reference in their entirety.

SUMMARY OF THE INVENTION

The present invention relates to a wheelchair curb-climbing and curb-descending system adapted to raise a wheelchair to, and lower a wheelchair from, (hereinafter in the description and claims: "negotiate" or a derivative thereof) a step-like elevated structure or surface such as a sidewalk curb (hereinafter in the specification and claims: "curb" or any derivative thereof). As the present system is particularly suited for use with motorized wheelchairs, the present system will be described in this context. However the present wheelchair curb-climbing and curb-descending system, mutatis mutandis, is not limited to motorized wheelchairs.

The term "curb" and its derivatives will be used herein the description and claims to indicate any relatively isolated obstacle of a curb-like nature, such as a sidewalk curb, a single stair, a step-up/down as may be found at a building or store entry-way, and so on. The term "curb" and its derivatives herein are not intended to include obstacles such as a flight of stairs.

In accordance with embodiments of one aspect of the present invention there is provided a wheelchair curb-climbing and curb-descending system for aiding a wheelchair to negotiate a curb. The system includes a wheelchair attachment mechanism for securing the system to the wheelchair; a pair of front arms, each front arm adapted and controllable to extend, or be positioned, forward and downward so as to lift a front portion of wheelchair and to retract back so as to lower the front portion of the wheelchair upon deployment of the system; a pair of rear arms, each rear arm adapted and controllable to extend, or be positioned, rearward and downward so as to lift a rear portion of wheelchair and to retract back so as to lower the rear portion of the wheelchair upon deployment of the system. The system further includes an arm extending mechanism having an arm extension and retraction motor associated with each of the front arms and with each of the rear arms for extending or positioning, and retracting the arms; a rotatable lifting-arm wheel disposed at the free ends of each front arm and each rear arm; a wheel motor associated with, and adapted for rotating, at least one of the arm wheels; an operation control unit adapted to actuate and control operation of the system; and a leveling mechanism operably connected to the arms for ensuring the seat of the wheelchair remains substantially level to the ground during operation of the system.

It is a particular feature of the present wheelchair curb-climbing and curb-descending system that it is adapted to negotiate a step-like elevated structure such as a sidewalk curb, essentially without tilting the user.

Additional particular features of the present system include that it is relatively lightweight, for example on the order of 40 kg; allows overcoming a curb of about 20 cm, within a reasonably quick period, for example approximately 10 seconds; and does not increase the existing footprint of the wheelchair so as not to interfere with maneuvering of the wheelchair or entry into doorways or the like.

BRIEF DESCRIPTION OF THE DRAWINGS

The present invention will be understood and appreciated more fully from the following detailed description taken in conjunction with the appended drawings in which.

Figure 1:
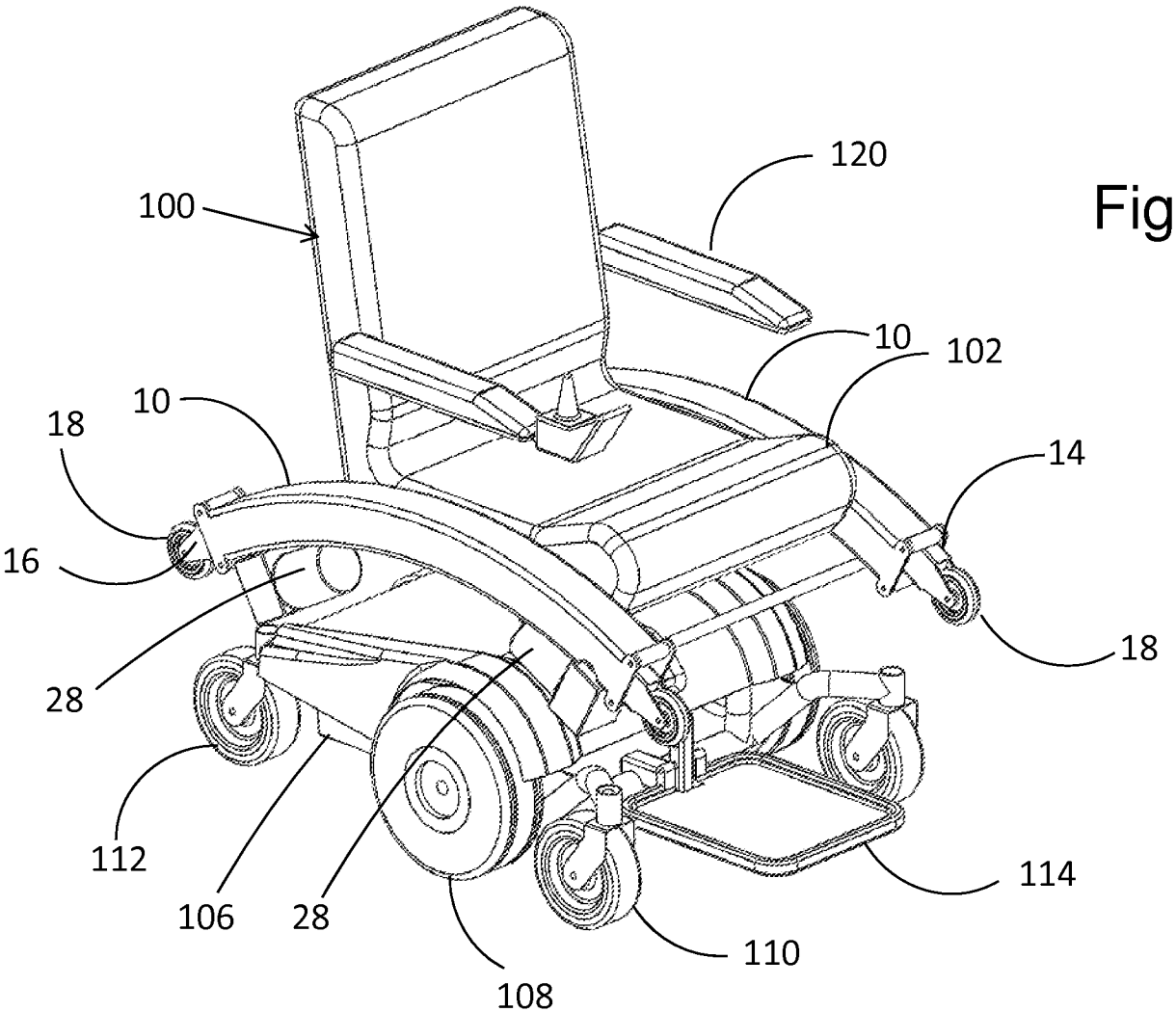
FIGS. 1-2 are respective generally front and rear perspective side views of a wheelchair fitted with or incorporating a wheelchair curb-climbing and curb-descending system in accordance with embodiments of the present invention.
Figure 2:
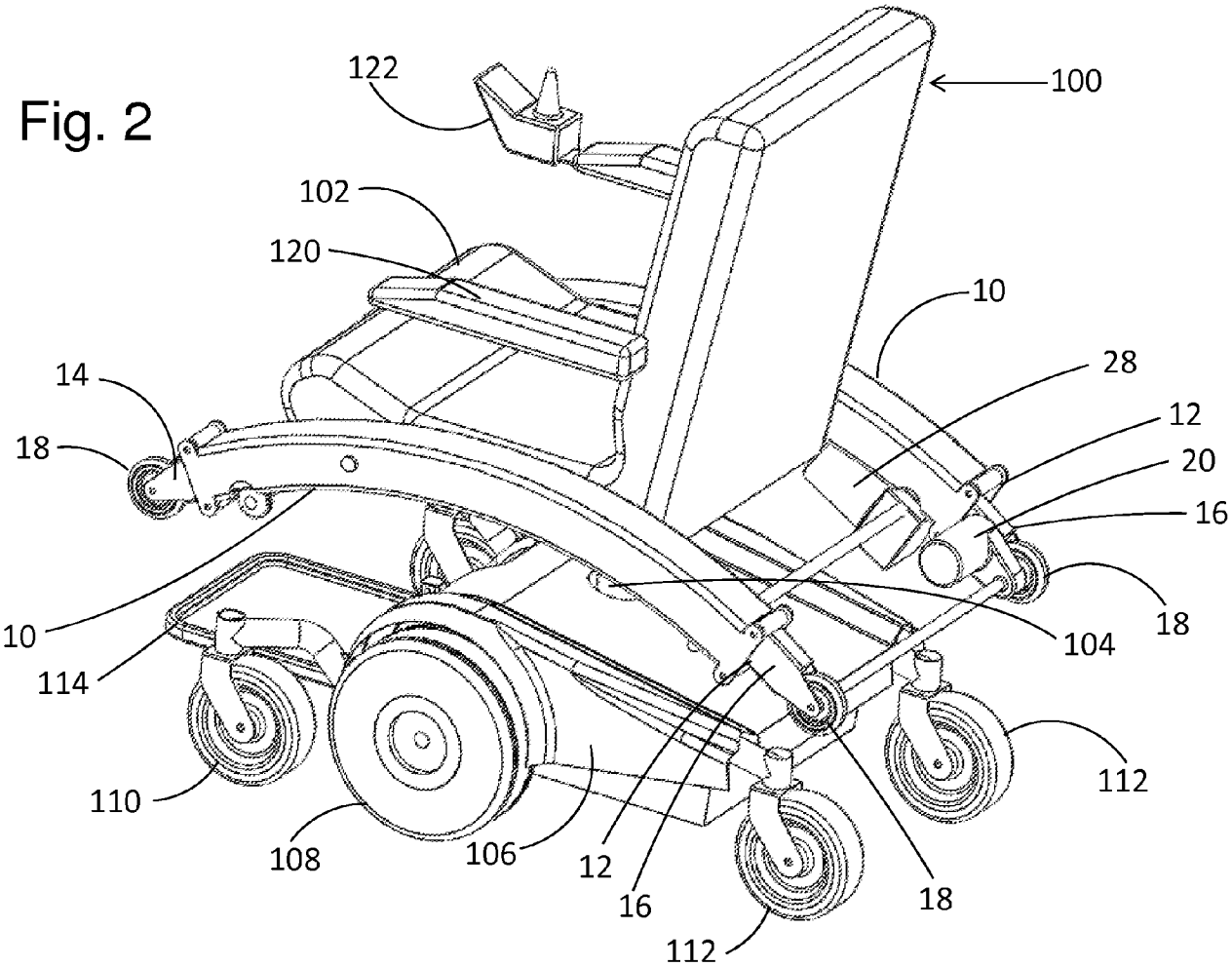
Figure 3:
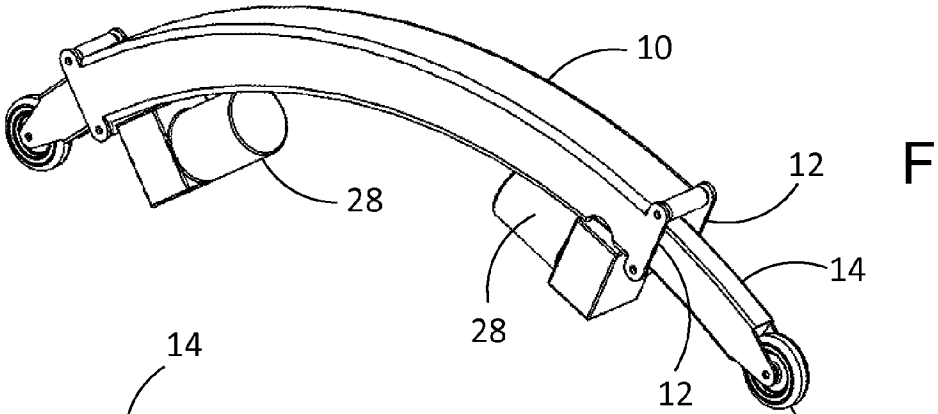
FIGS. 3-5 are views of extendable lifting arms of the wheelchair curb-climbing and curb-descending system side, a perspective and two side views, respectively.
Figure 4:
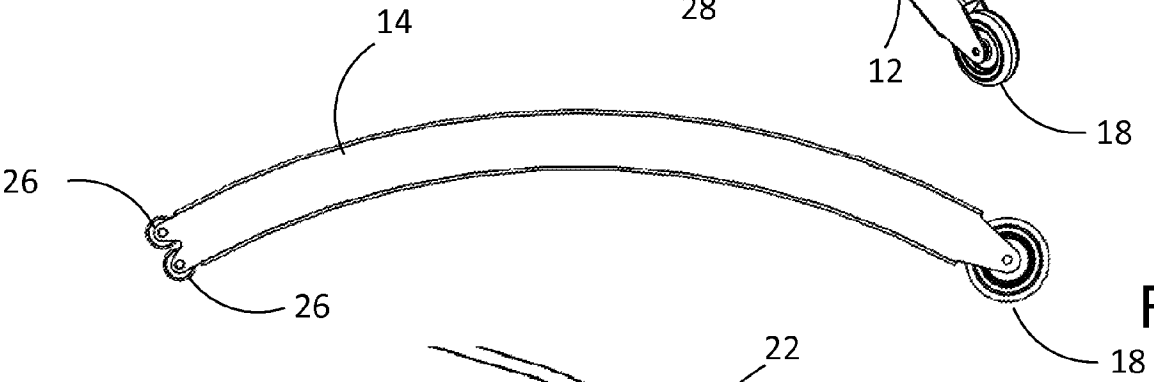
Figure 5:
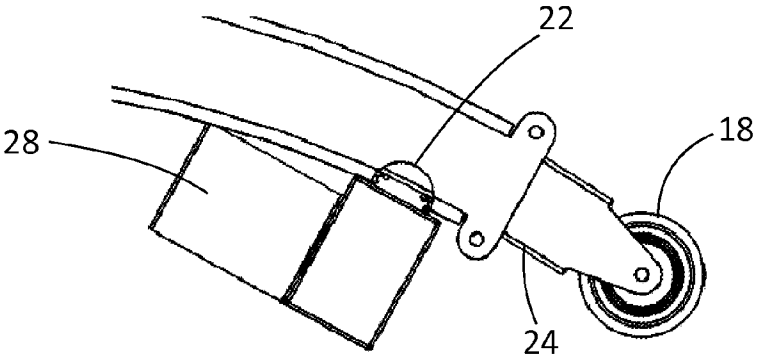
Figure 6:
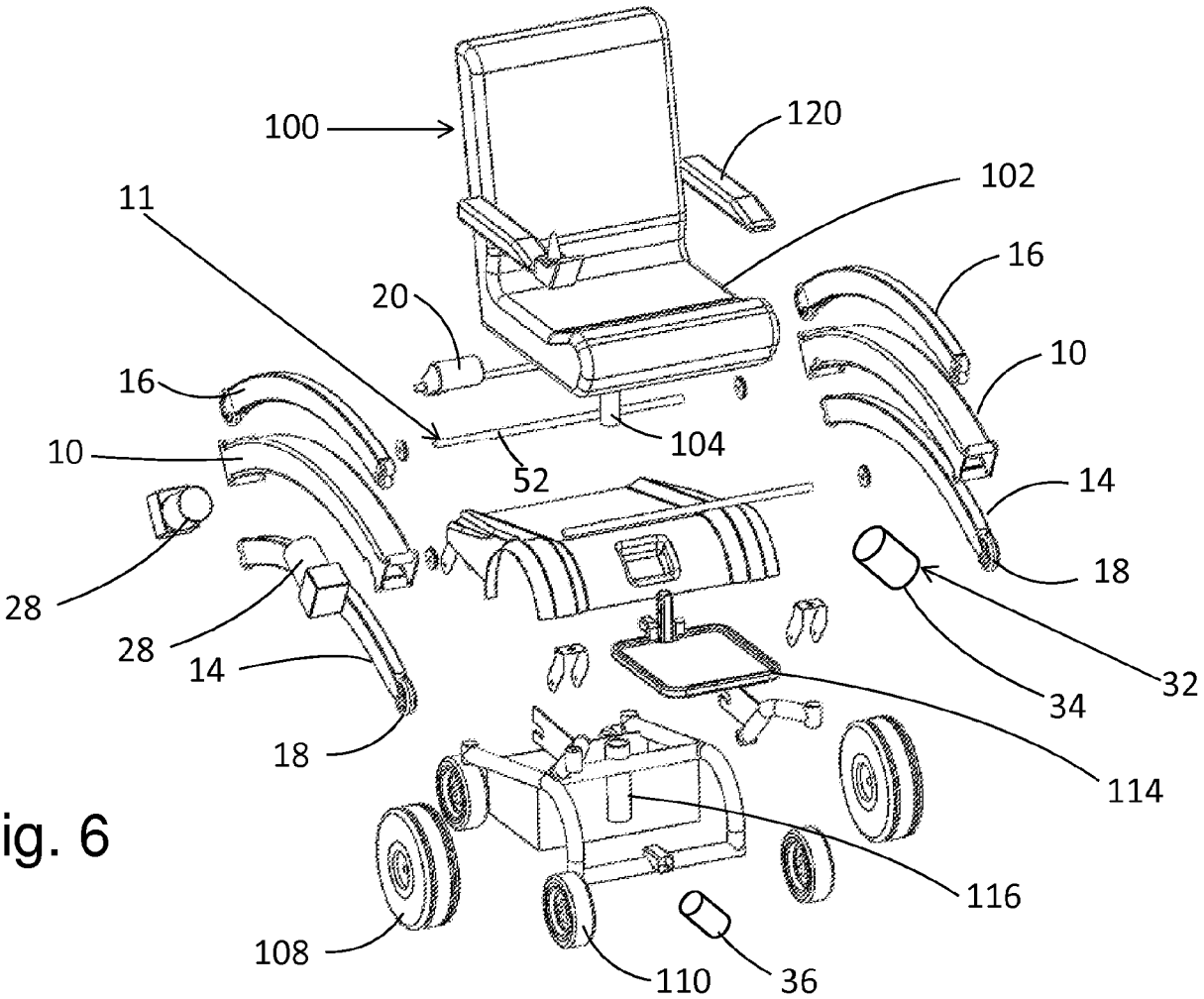
FIG. 6 is a perspective exploded view of the wheelchair with the curb-climbing and curb-descending system.

The following detailed description of embodiments of the invention refers to the accompanying drawings referred to above. Dimensions of components and features shown in the figures are chosen for convenience or clarity of presentation and are not necessarily shown to scale. Wherever possible, the same reference numbers will be used throughout the drawings and the following description to refer to the same and like parts.

DETAILED DESCRIPTION OF THE INVENTION

Illustrative embodiments of the invention are described below. In the interest of clarity, not all features/components of an actual implementation are necessarily described.

FIGS. 1-6 also show a first embodiment and including optional modifications thereof, of the present wheelchair curb-climbing and curb-descending system for use with a wheelchair. Without limitation, the system is particularly suited for use with a motorized wheelchair and will be described in that context. The wheelchair typically comprises a chair 100, including a seat 102 and a chair support shaft 104; a base 106; a set of drive wheels 108; a set of front casters or wheels 110; a set of rear stabilizing wheels 112; footrest(s) 114; a propulsion power source (such as one or more batteries) and motor 116; arm rests 120 and a operation control unit 122 for the user to control the movement of the wheelchair.

In some embodiments, the curb-climbing and curb-descending system comprises a pair of lifting-arm housings 10, one housing on each side of the wheelchair. Arm housings 10 are made of a sturdy material, such as aluminum and in some preferred embodiments, are arcuate, as shown. The system includes a wheelchair attachment mechanism 11 (including in some embodiments a generally transversely oriented connector rod 52 and associated fasteners, FIG. 6) that typically connects the system to the wheelchair for example via an attachment between the system (e.g. arm housings 10) and chair support shaft 104, though the system could be attached in other ways and means, for example to base 106, etc.

Each arm housing 10 has a pair of arm receiving tunnels 12, one tunnel configured to house a correspondingly shaped frontward/downward extendable wheelchair lifting and lowering arm 14 (herein-after in the specification and claims also/interchangeably referred to as "front arms" 14, regardless of the method of their operation) and the other tunnel configured to house a correspondingly shaped rearward/downward extendable wheelchair lifting and lowering arm 16 (herein-after in the specification and claims also referred to as "rear arms" 16, regardless of the method of their operation). At the free ends of each lifting arm 16 are wheelchair lifting-arm wheels 18, rotatable via a wheel motor 20 as part of an arm extending mechanism. For such purpose, in some embodiments, each wheel motor 20 of the arm extending mechanism has an associated gear wheel 22 (FIG. 5); and each lifting/lowering arm (front arms 14 and rear arms 16) has a toothed portion or toothed rail 24 (FIG. 5) corresponding to its respective gear wheel. In some modifications, the arm extending mechanism includes friction rollers (not shown) or a pulley device (not shown) rather than gear wheels.

For smooth operation during extension and retraction, each lifting/lowering arm 14 and 16 also typically has a roller or pair of rollers 26 for interfacing with the inner surface of tunnels 12 of housing 10. A lifting-arm extension and retraction motor 28 is associated with each of lifting/lowering arms 14 and 16, for extending and retracting the arms.

In some preferred embodiments, a rear (or front) pair of lifting-arm wheels 18 are connected by an axle 30 so that both of the pair of wheels will be rotatable by wheel motor 20. In some embodiments, each wheel 18 has an associated motor such as wheel motor 20. In some embodiments, each pair of wheels, connected by an axle such as axle 30, has an associated motor such as wheel motor 20.

In some embodiments, the curb climbing and curb-descending system further includes a leveling mechanism 32 (FIG. 6) including one or more level or inclinometer sensors 34 operably engaged with wheel motor(s) 20 to control the relative extension of arms 14 and 16 so as to ensure that seat 102 (i.e. the user) is maintained level to the ground during lifting and descent of the wheelchair.

In some embodiments, the curb climbing and curb-descending system includes one or more sensors 36 (e.g. a pressure/contact sensor, FIG. 6) to detect when wheels 18 interface with the ground so as to control the relative extension of arms 14 and 16 so as to ensure that seat 102 (i.e. the user) is maintained level to the ground during lifting and lowering of the wheelchair.

In some embodiments, the relative extension of arms 14 and 16 are controllable by the user, for example via operation control unit 122, which is typically used in any event to actuate the curb climbing and curb-descending system. While the exact amount of lifting of the wheelchair is clearly a function of the dimensions and/or design of the system, it is envisioned that an ascent and descent of about twenty centimeters is sufficient to negotiate most typical curbs and the like. Furthermore, although there is no theoretic time limit on the operation, the system as presented can be designed to reasonably complete an ascent or descent in about ten seconds or so.

Figure 7A:
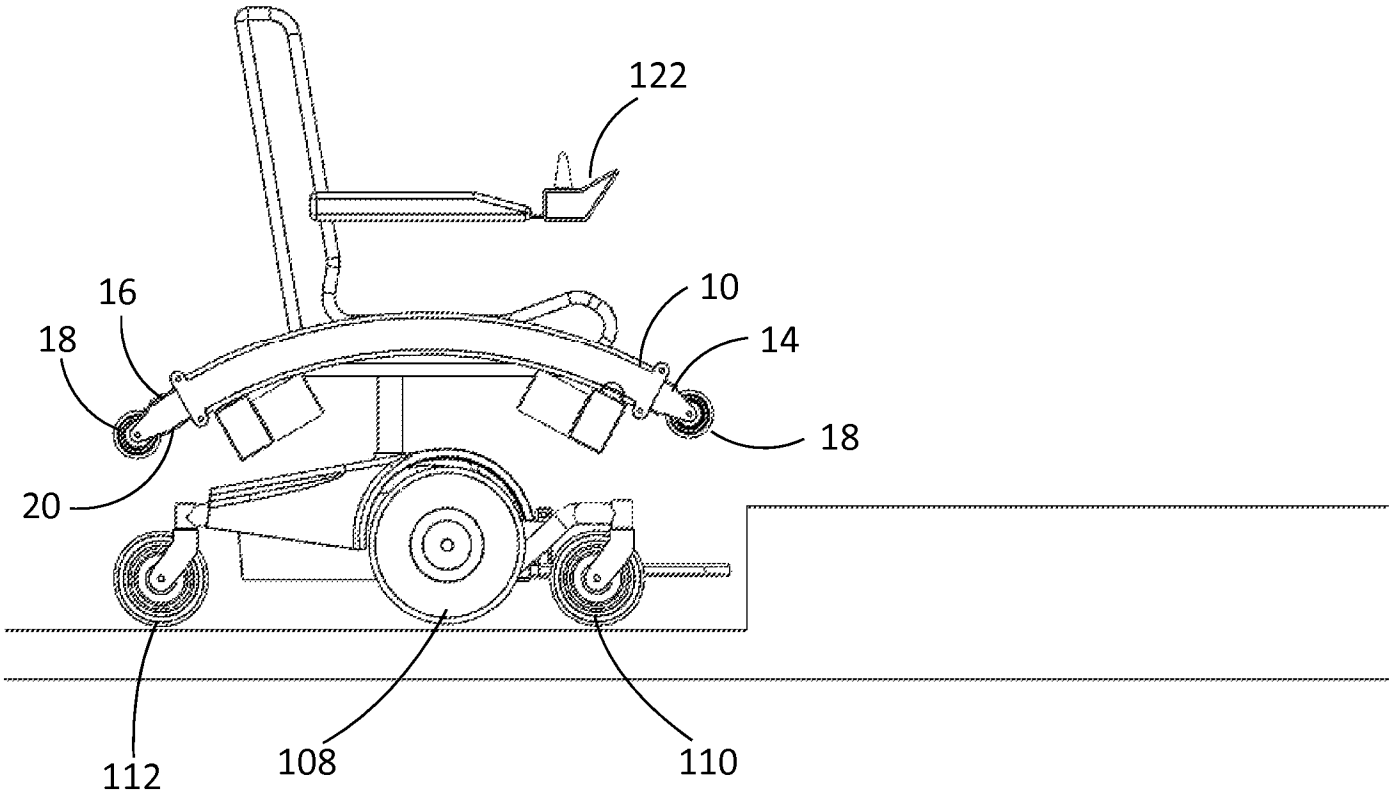
FIGS. 7A-7I are side views of wheelchair curb-climbing and curb-descending system in various states of operation.
Figure 7B:
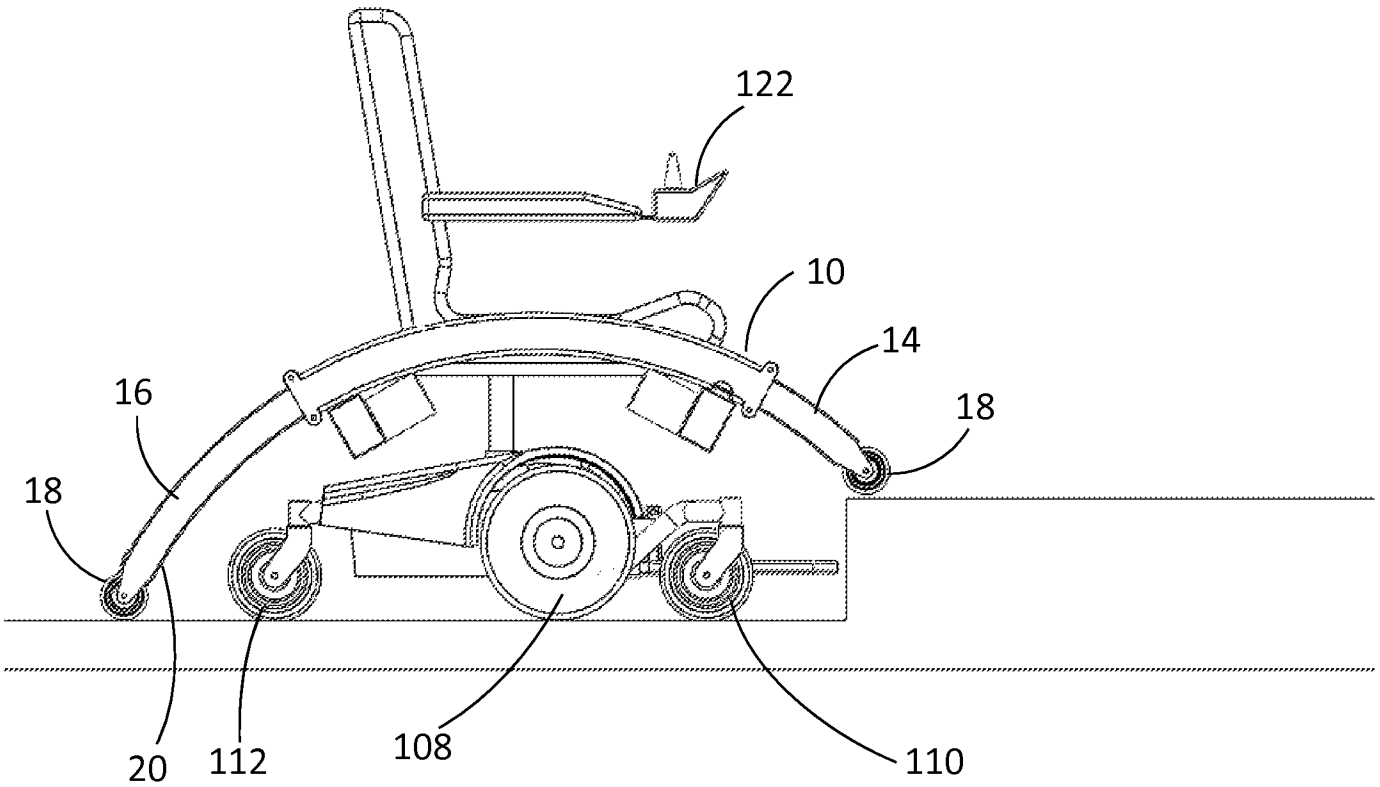
Figure 7C:
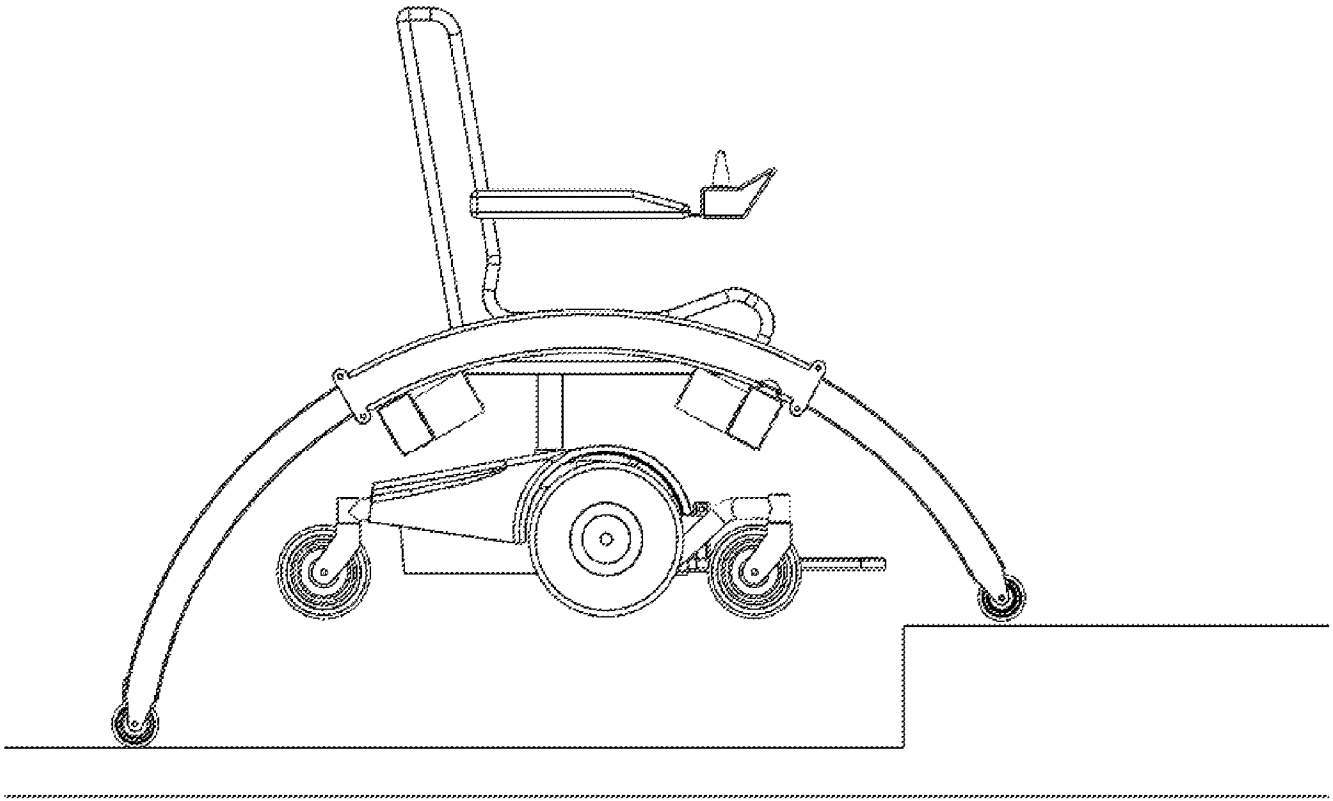
Figure 7D:
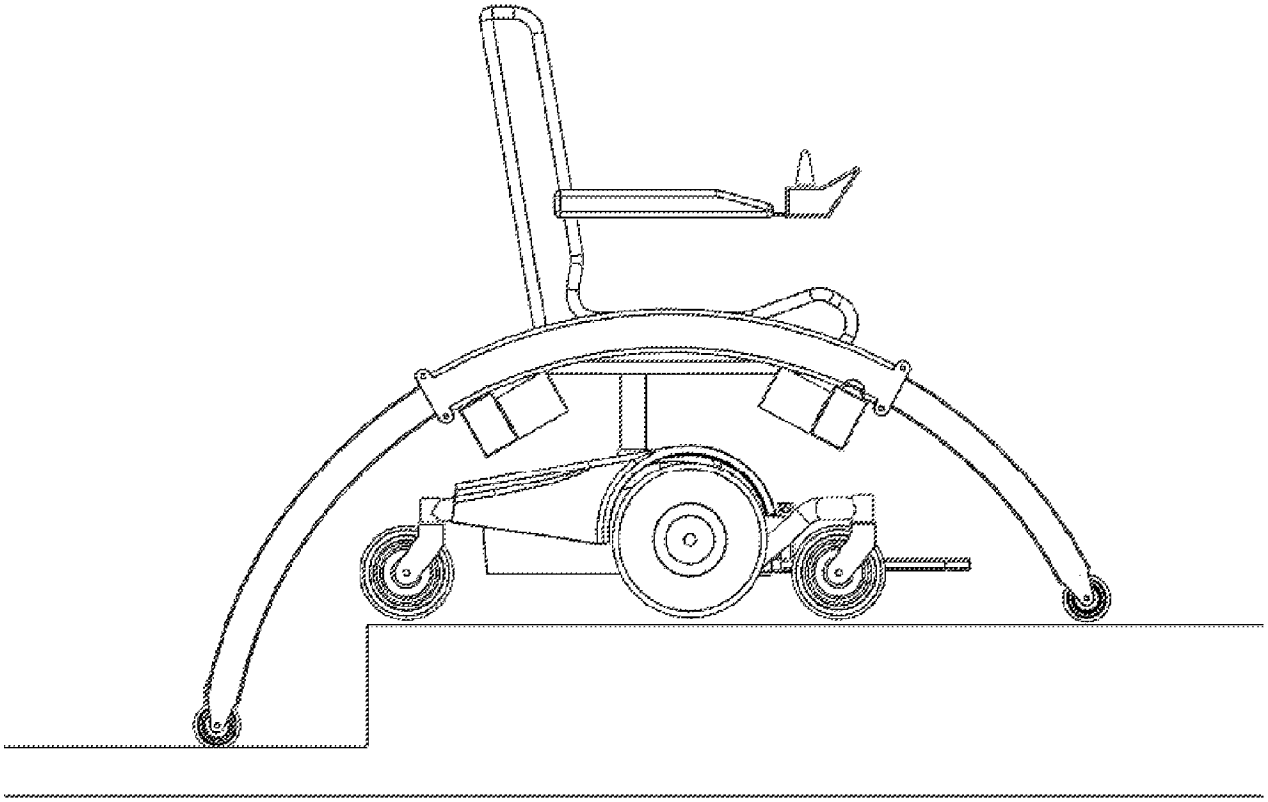
Figure 7E:
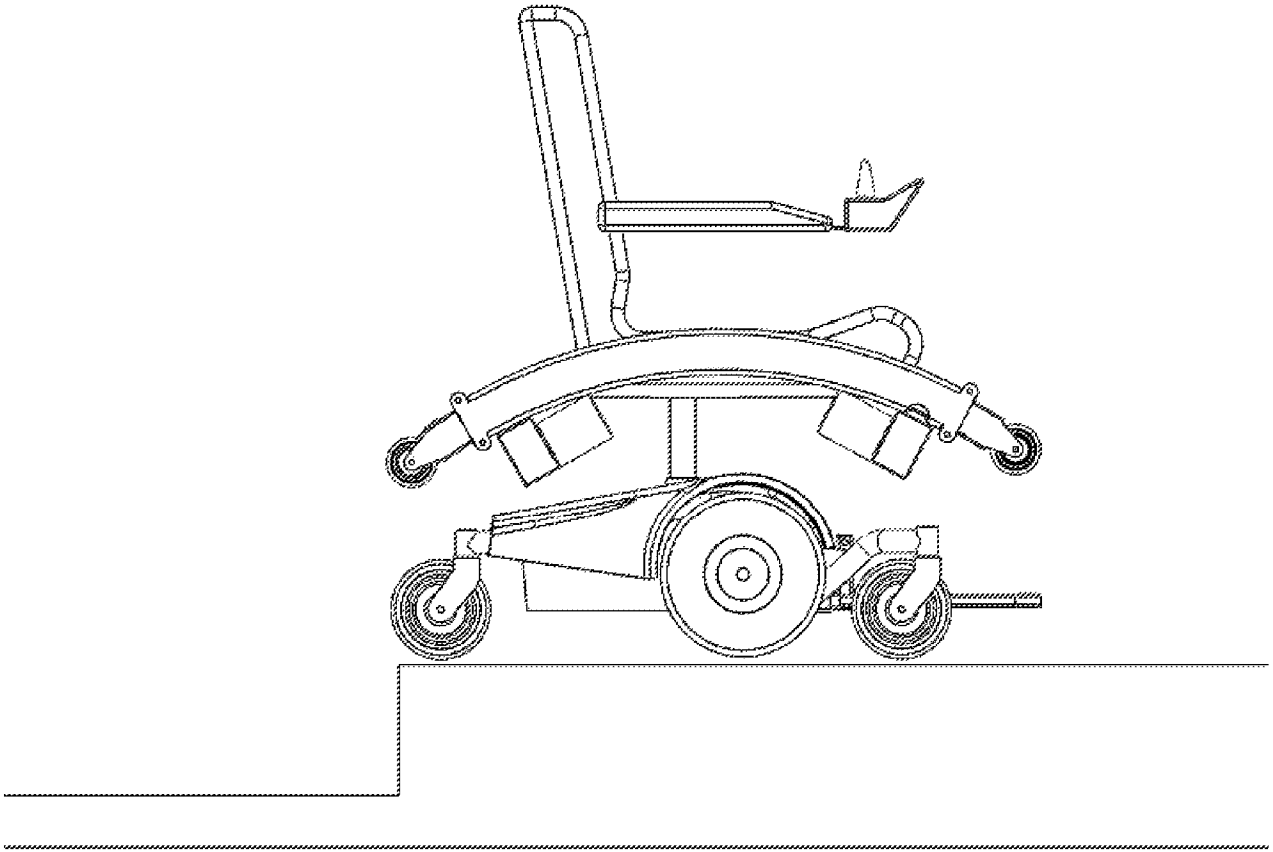
Figure 7F:
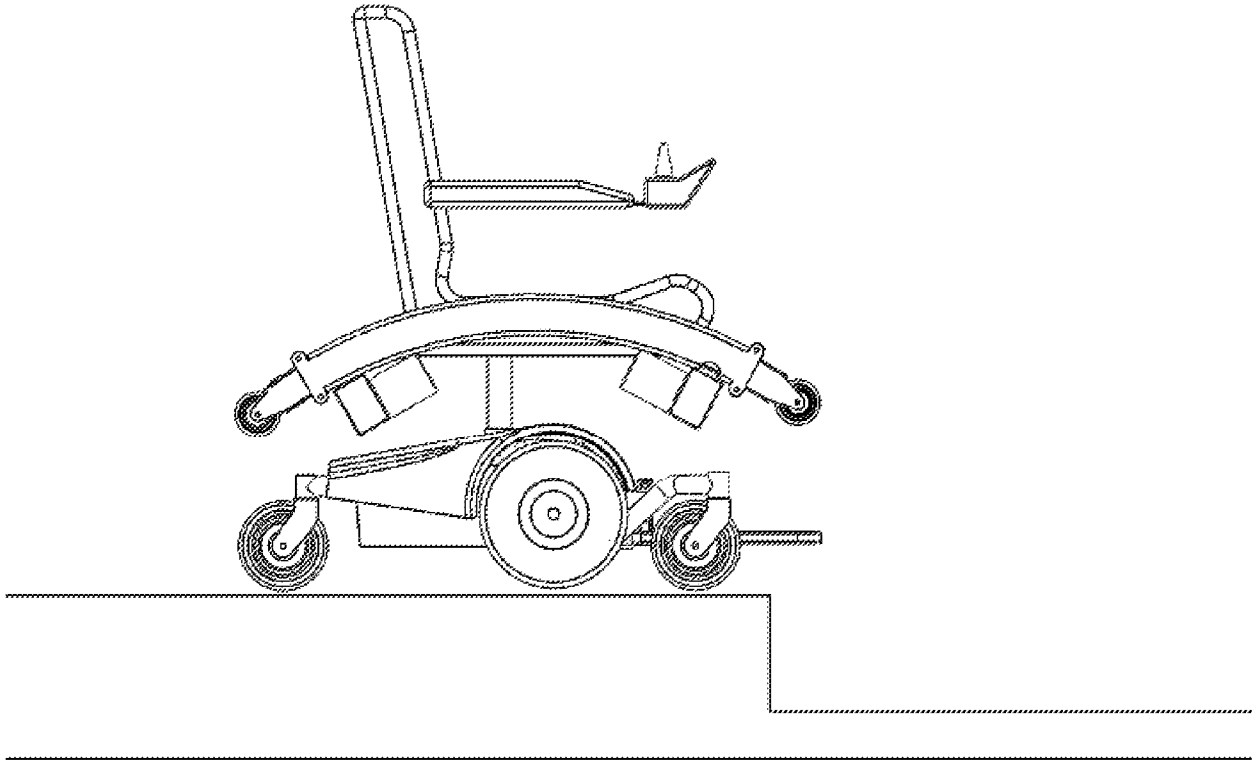
Figure 7G:
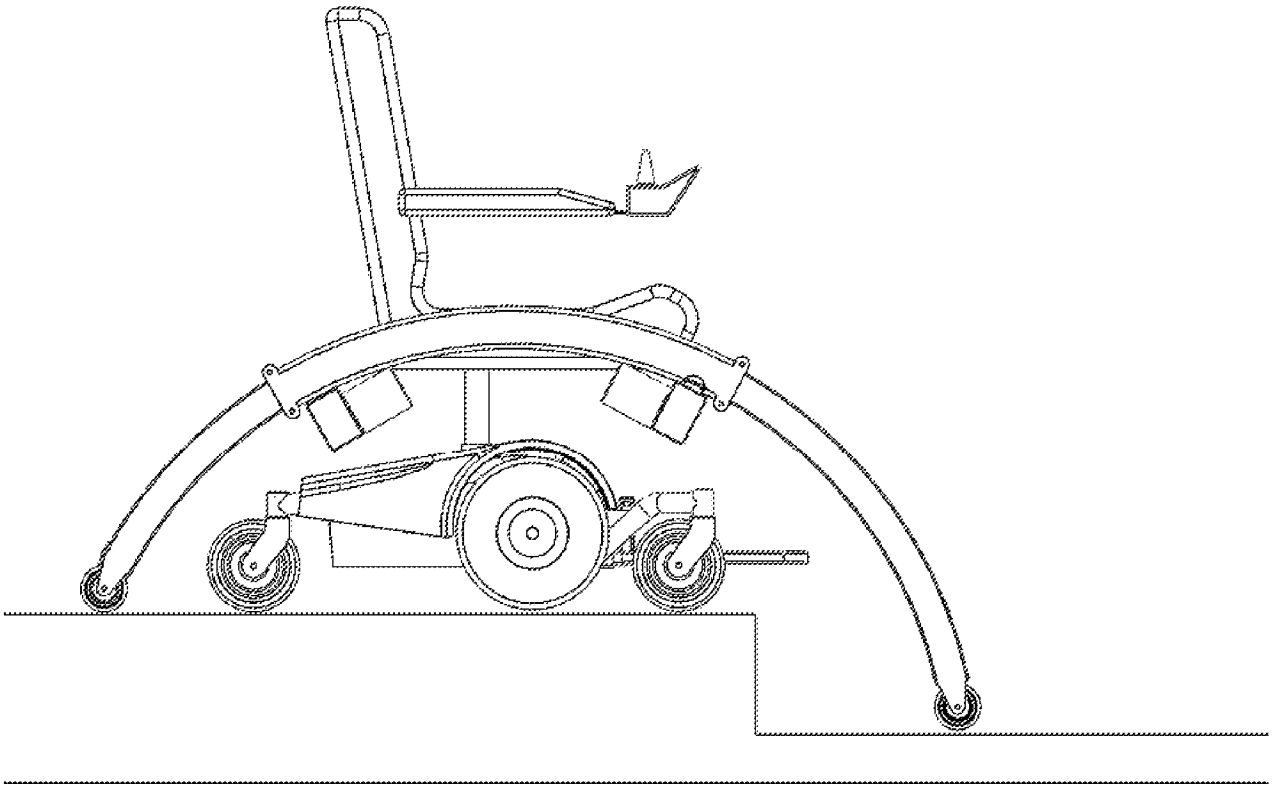
Figure 7H:
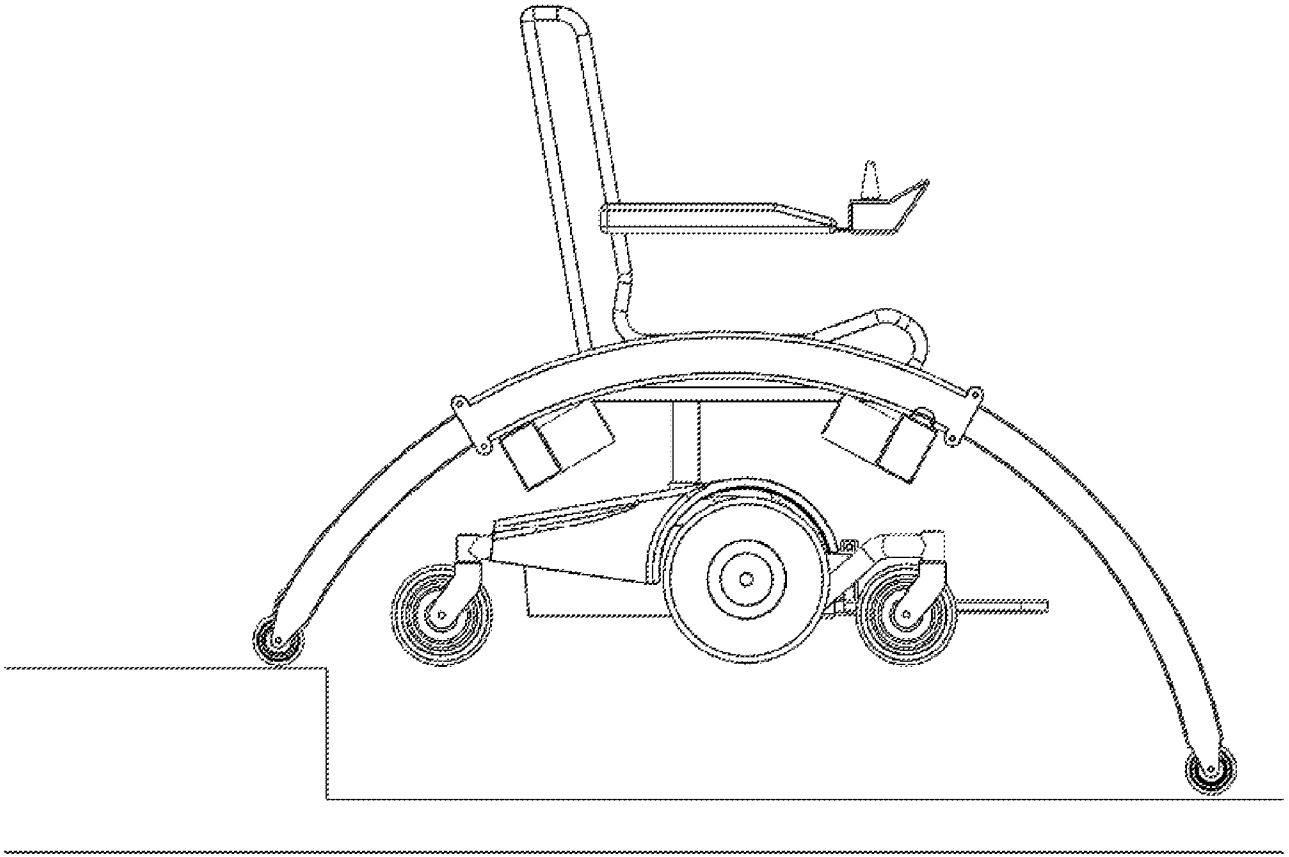
Figure 7I:
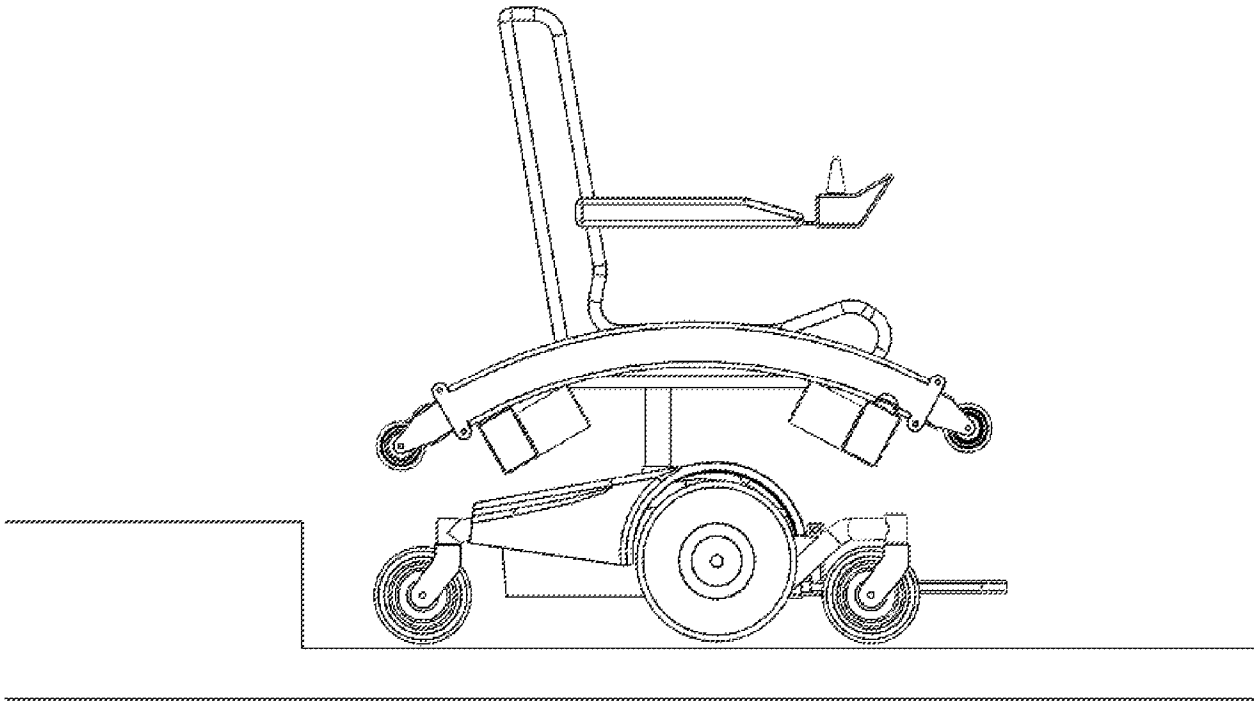
Figure 8A:
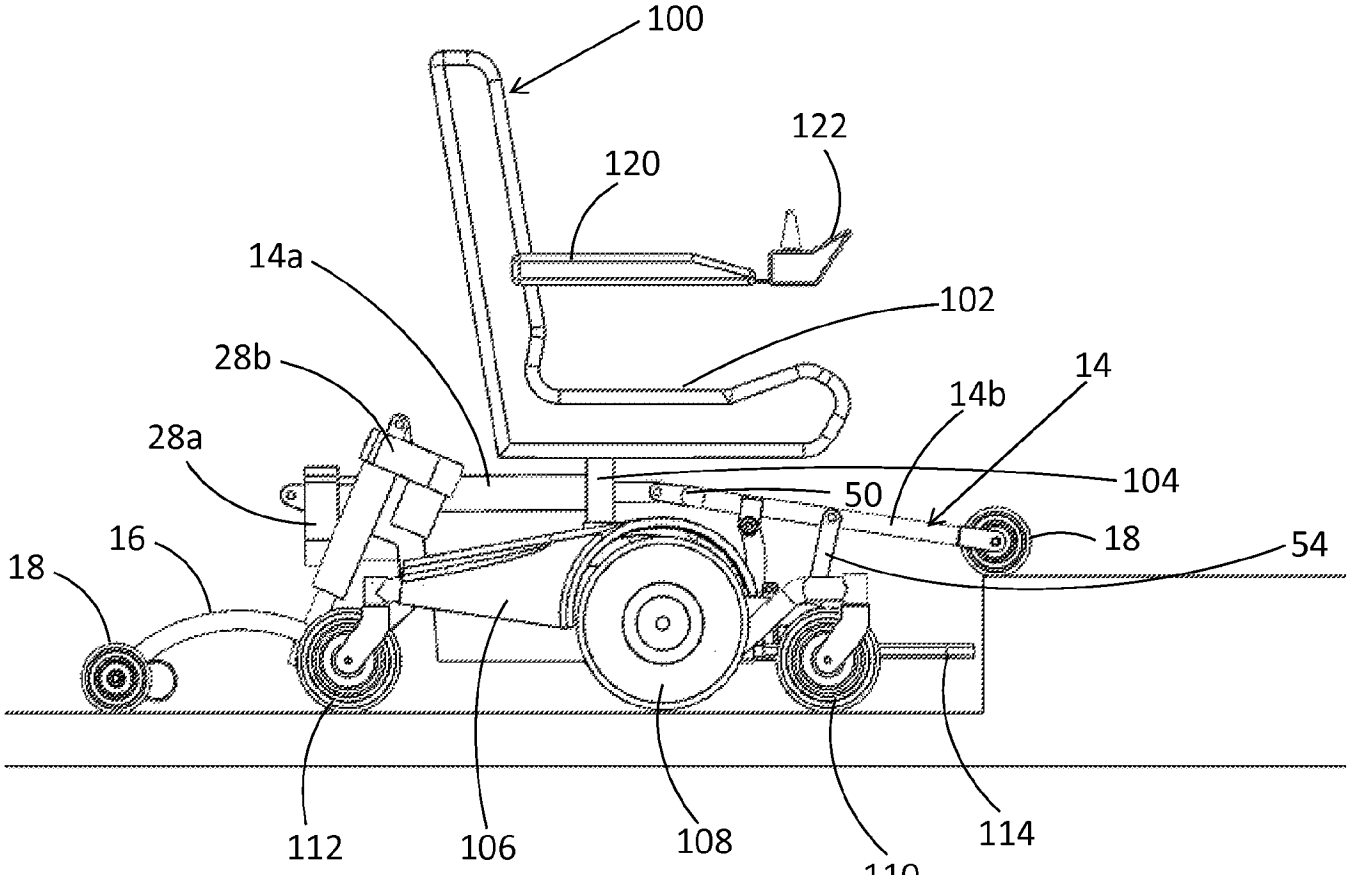
FIGS. 8A-8H are side views of another embodiment of the wheelchair curb-climbing and curb-descending system in various states of operation.
Figure 8B:
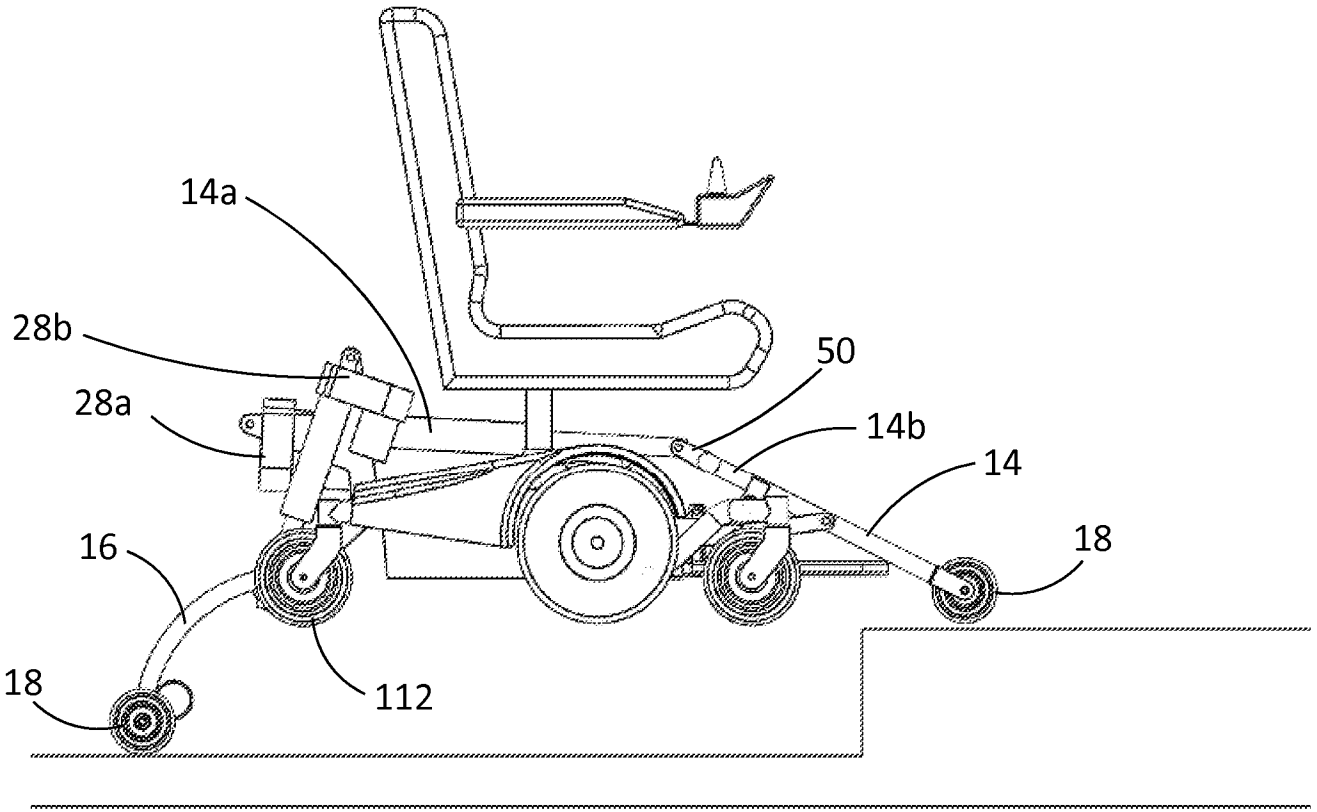
Figure 8C:
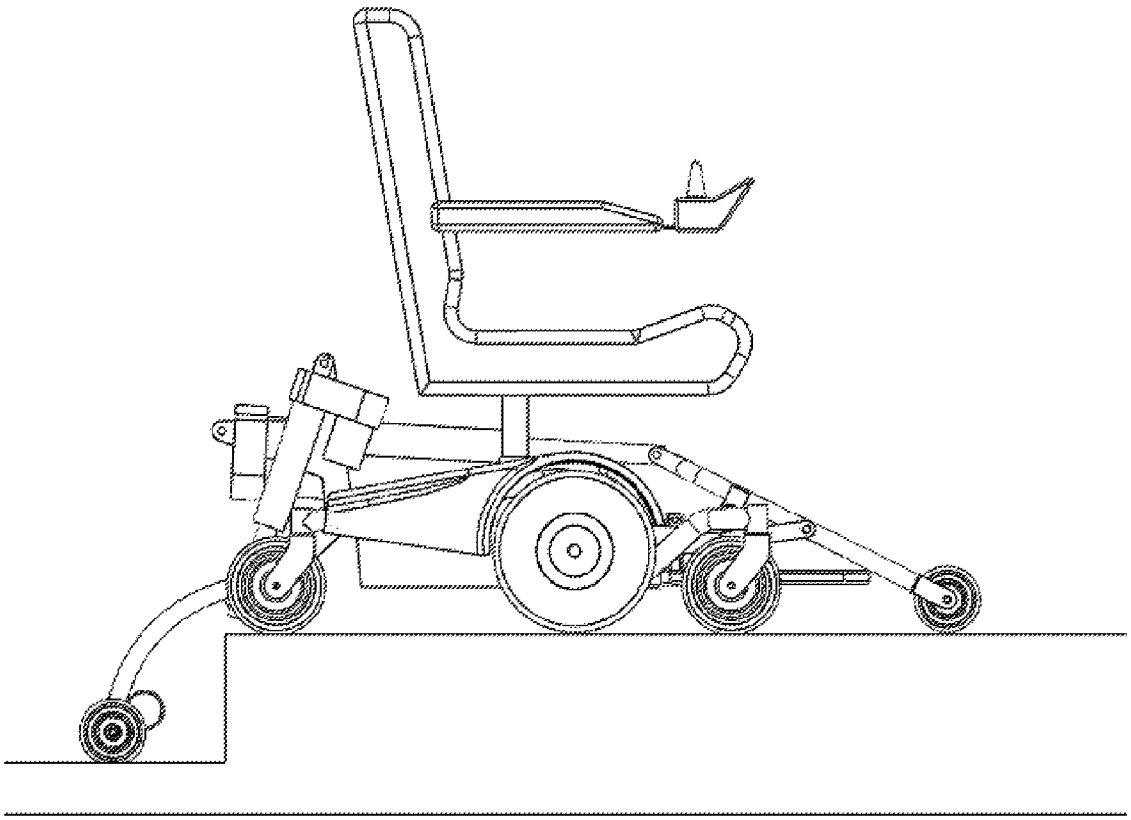
Figure 8D:
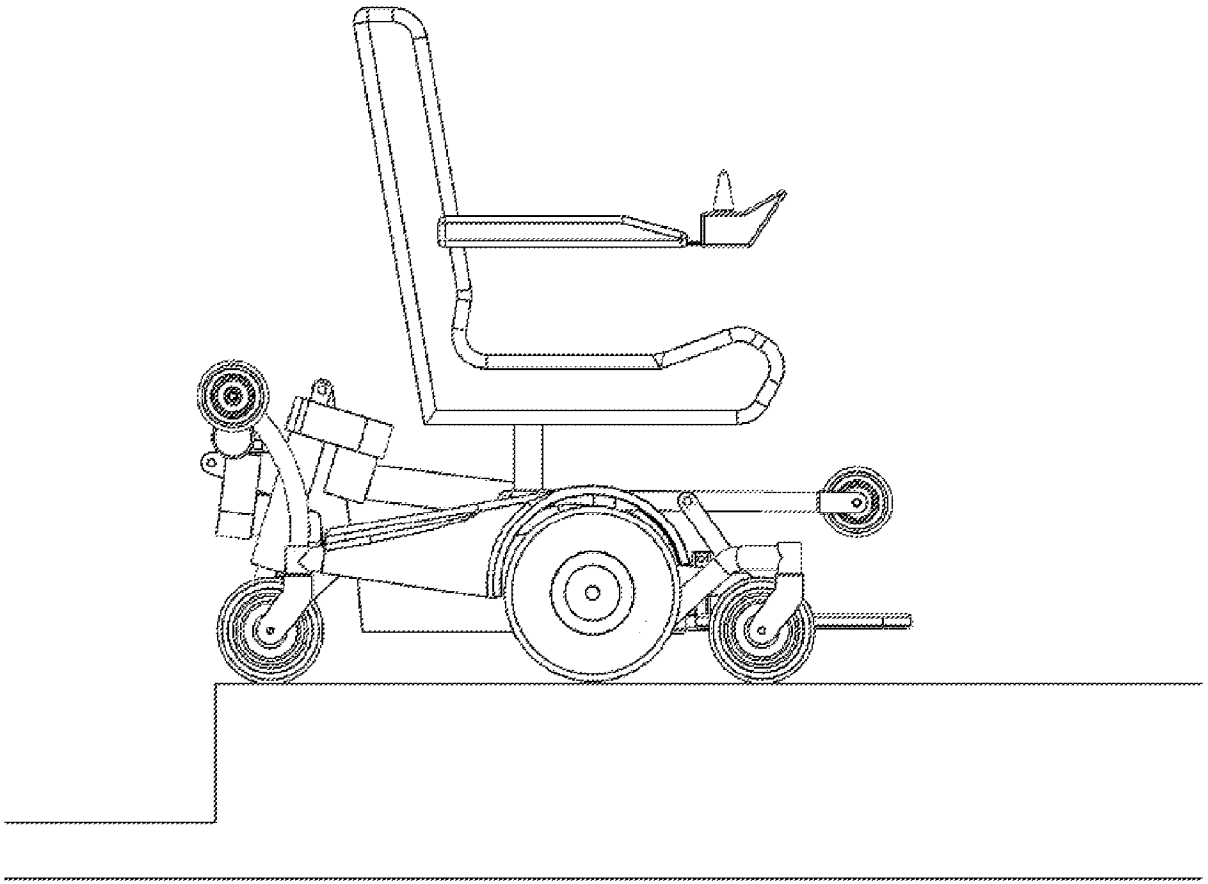
Figure 8E:
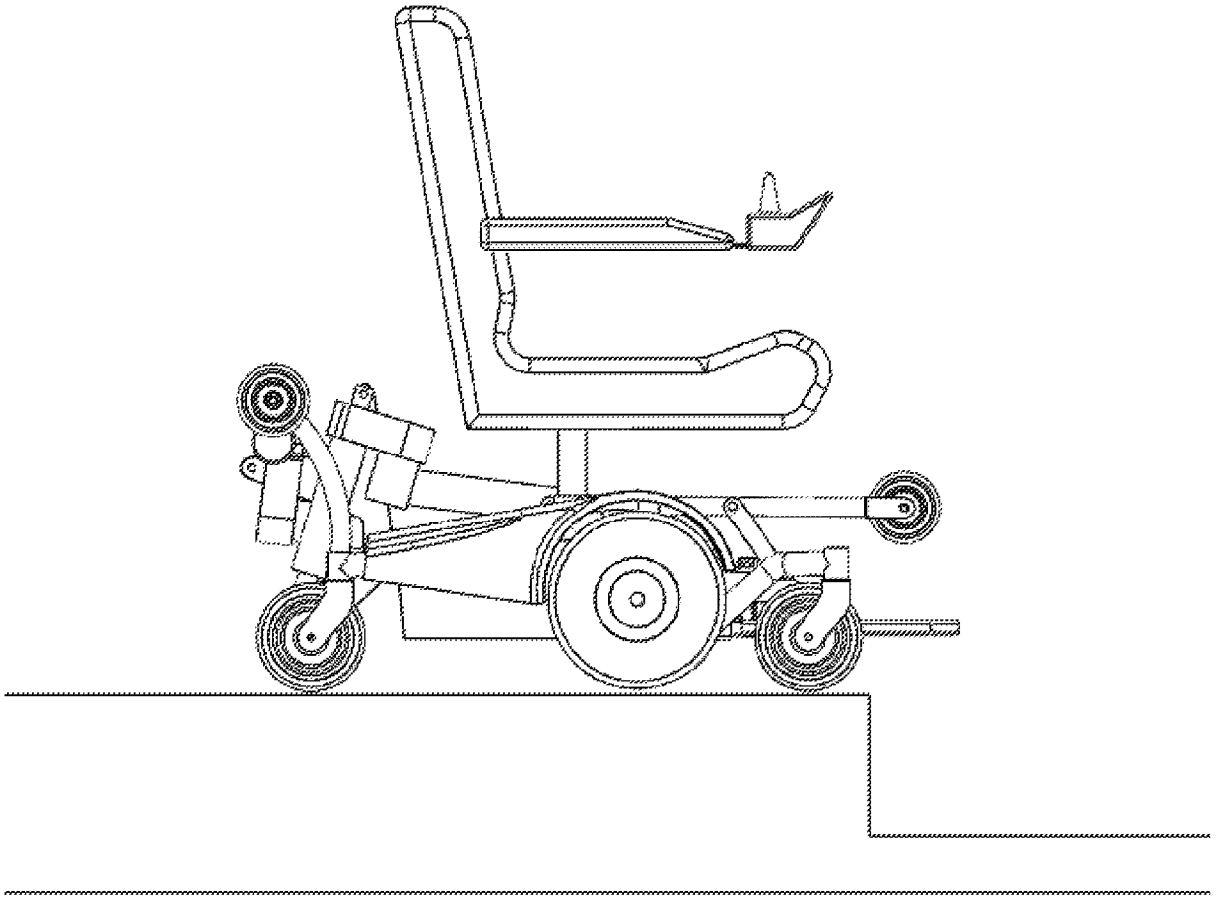
Figure 8F:
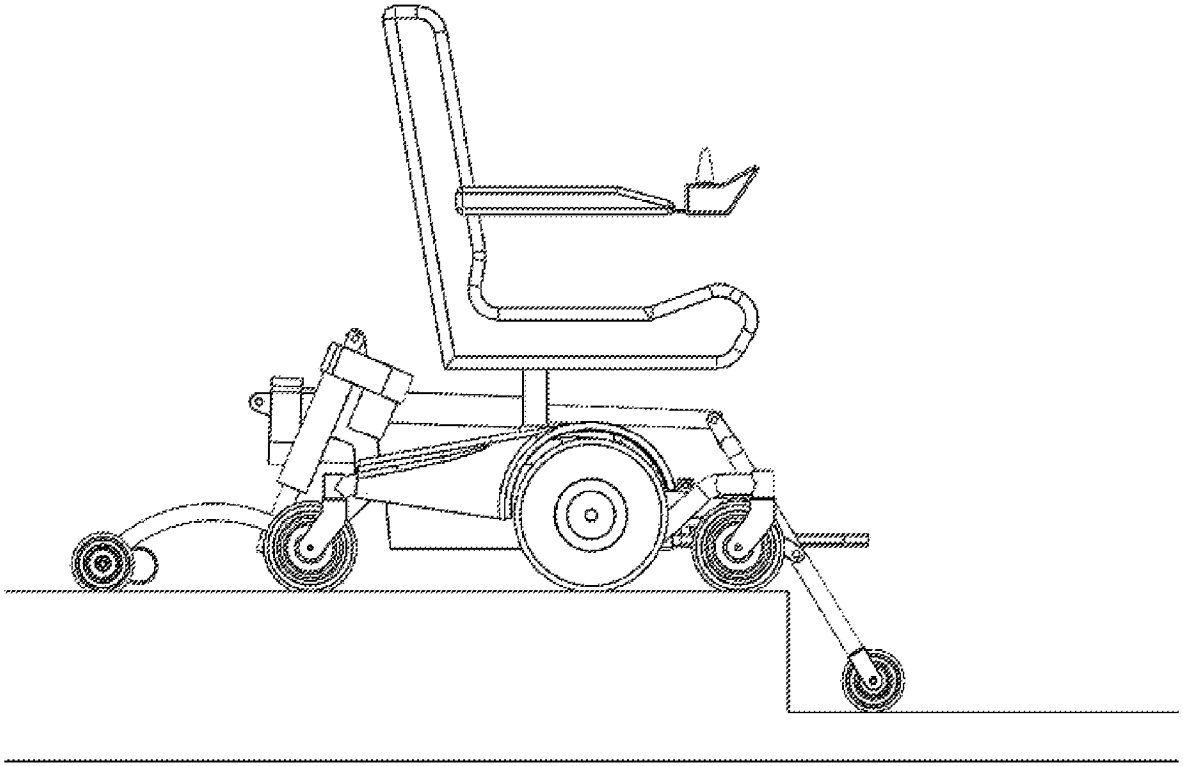
Figure 8G:
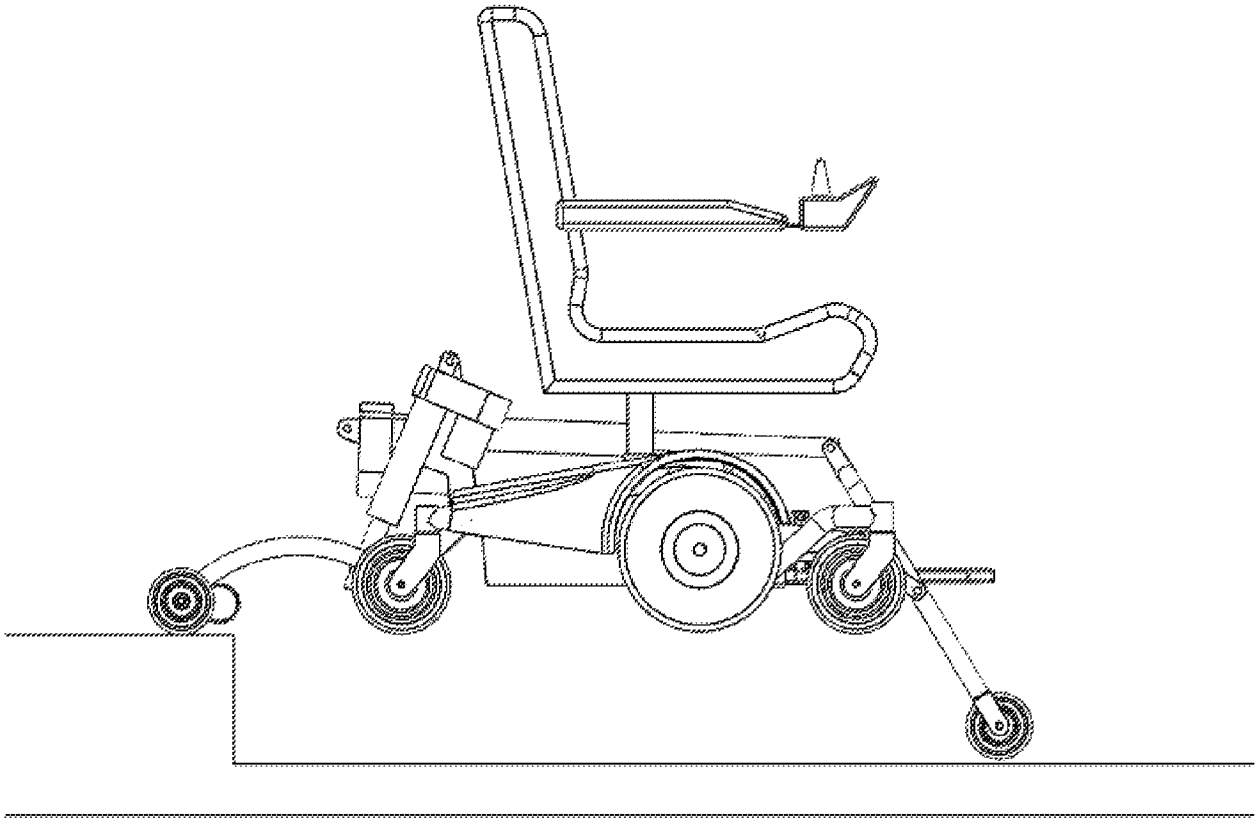
Figure 8H:
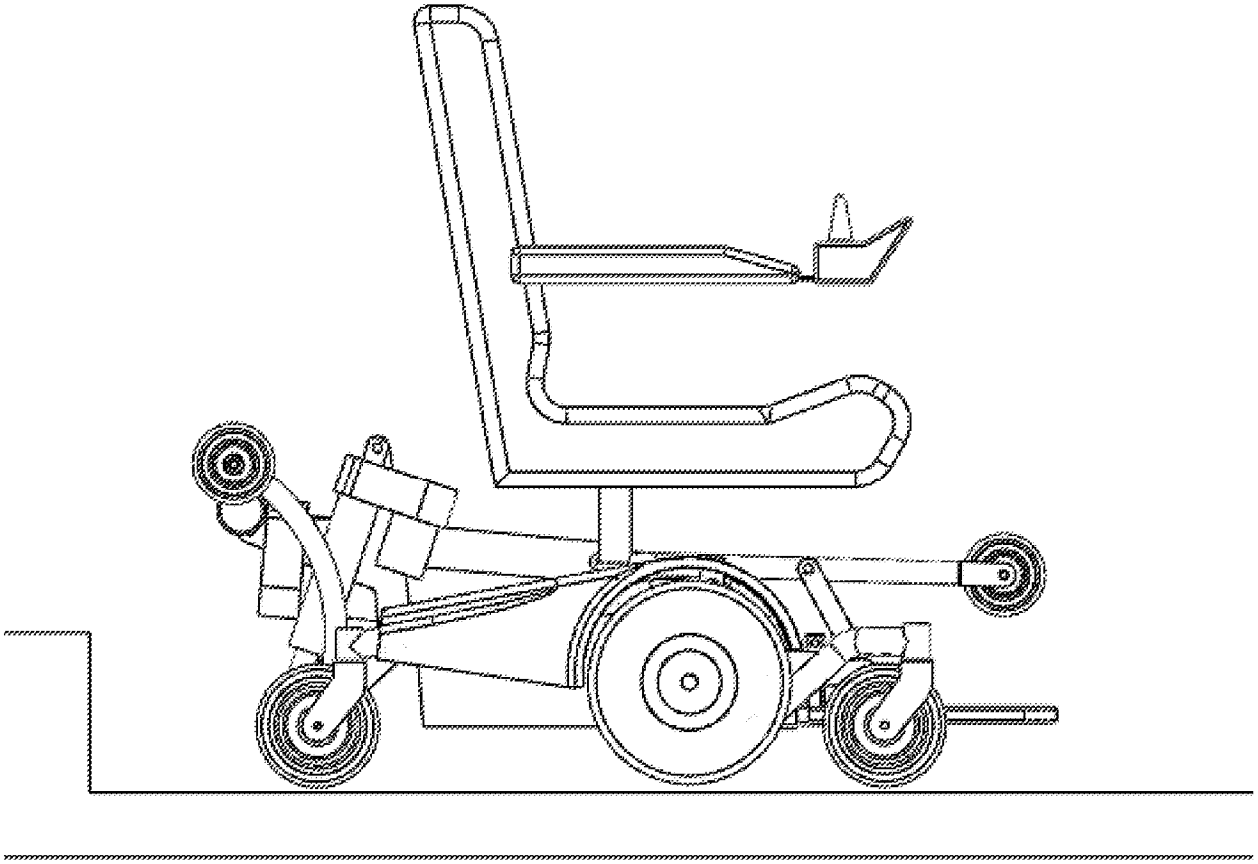

Operation:

In reference to operation, FIG. 7A shows the approach to a curb to be climbed; FIG. 7B shows the curb-climbing and curb-descending system being deployed; FIG. 7C shows the system after it has lifted the wheelchair to the level of the curb; FIG. 7D shows the system advancing the wheelchair onto the curb; and FIG. 7E shows the wheelchair after it has completed the curb climbing. FIG. 7F shows the approach to a curb to be descended; FIG. 7G shows the system being deployed for the descent; FIG. 7H shows the system advancing the wheelchair off the curb; and FIG. 7I shows the wheelchair after it has completed the curb descent.

To operate the system, the user uses operation control unit 122 to actuate the system when adjacent a curb or the like that the user needs help to ascend or descend. Taking an ascent for example, when frontward/downward extendable wheelchair lifting/lowering arms 14 are above the curb, the system is actuated and lifting-arm extension and retraction motors 28 are operated to extend arms 14 and 16. Depending on the exact nature of the aforementioned sensors, the extension of arms 14 and arms 16 are controlled so that seat 102 (i.e. the user) is kept level to the ground whereby the seat/user is not tilted, which provides stability to the operation as well as comfort to the user. The absolute extent of the extension of the arms is typically controlled (and the system designed accordingly) so that the arms raise the wheelchair approximately twenty centimeters whereby most curbs can be negotiate.

After wheels 18 of arms 14 and 16 engage the ground, wheel motor 20 operates to rotate at least one of wheels 18 to thereby propel the wheelchair forward. When all of the (standard) wheels 108, 110 and 112 are above the curb surface, arms 14 and 16 are retracted, typically by the user.

A descent is generally similar. When the user is on a curb but adjacent a step off, the user actuates the system and arms 14 and 16 are extended by motors 28. Sensors 34 ensure that seat 102 remains substantially parallel to the ground and wheel(s) 18 are rotated as mentioned above. When all of the (standard) wheels 108, 110 and 112 have cleared the curb surface, arms 14 and 16 are retracted, typically by the user. In some embodiments, the system may include a further sensor to let the user know when to actuate retraction of arms 14 and 16, or such control can be automatic.

Generally analogously to FIGS. 7A-7I, FIGS. 8A-8H show the operation of another embodiment, including optional modifications thereof, of the present wheelchair curb-climbing and curb-descending system. In these embodiments, there is no housing 10 for housing arms 14 and 16 and the arms are typically attached to base 106, or other appropriate component, rather than to a housing such as housing 10. Front motors 28*a* associated with frontward/downward extendable wheelchair lifting/lowering front arms 14 are adapted to move a first segment 14*a* of each arm 14 so as to move a second segment 14*b*, pivotably connected to the first segment at a pivot or axis 50, of each arm 14 in order to lower wheels 18 when ascending a curb and in order to raise wheels 18 when descending a curb. In some embodiments, second segment 14*b* of arms 14 is attached to the wheelchair, for example to base 106 via attachment member 54; although in other embodiments, depending upon the structure and design, arms 14, in particular second segments 14*b*, are directly attached to the wheelchair.

Rear motors 28*b* are associated with rear arms 16 and are adapted to pivot arms 16 downward (upon ascent) and upward (upon descent). In some embodiments, rear arms 16 are attached to the wheelchair at wheels 112.

It should be understood that the above description is merely exemplary and that there are various embodiments of the present invention that may be devised, mutatis mutandis, and that the features described in the above-described embodiments, and those not described herein, may be used separately or in any suitable combination; and the invention can be devised in accordance with embodiments not necessarily described above.

What is claimed is:

1. A wheelchair curb-climbing and curb-descending system for aiding a wheelchair having a seat to negotiate a curb, the system comprising:

a wheelchair attachment mechanism for securing the system to the wheelchair;

a pair of arcuate front arms, each of the arcuate front arms adapted and controllable to arcuately extend forward and downward so as to lift a front portion of the wheelchair and to arcuately retract back so as to lower the front portion of the wheelchair upon deployment of the system;

a pair of arcuate rear arms, each of the arcuate rear arms adapted and controllable to arcuately extend rearward and downward so as to lift a rear portion of the wheelchair and to arcuately retract back so as to lower the rear portion of the wheelchair upon deployment of the system;

an arm extending mechanism comprising an arm extension and retraction motor associated with each of the arcuate front arms and with each of the arcuate rear arms for extending or positioning, and retracting the arcuate front arms and arcuate rear arms;

a rotatable lifting-arm wheel disposed at free ends of each of the arcuate front arms and each of the arcuate rear arms;

a wheel motor associated with, and adapted for rotating, at least one of the lifting-arm wheels;

an operation control unit adapted to actuate and control operation of the system;

a leveling mechanism operably connected to the arcuate front arms and the arcuate rear arms and configured to ensure that the seat of the wheelchair remains substantially level to the ground during operation of the system; and wherein the system further comprises a pair of arm housings for housing the front arms and the rear arms; each of the arm extension and retraction motors of the arm extending mechanism has an associated gear wheel; and each of the front arms and each of the rear arms has a toothed portion or toothed rail corresponding to the respective gear wheels.

2. The system according to claim 1, wherein the front arms are attached to the wheelchair via an attachment rod.

3. The system according to claim 1, wherein the leveling mechanism includes at least one inclinometer sensor.

* * * * *